US009759241B2

(12) United States Patent
Missing et al.

(10) Patent No.: US 9,759,241 B2
(45) Date of Patent: Sep. 12, 2017

(54) PRESSURE COMPENSATOR

(71) Applicant: ABB TECHNOLOGY AG, Zürich (CH)

(72) Inventors: Kim Missing, Vaasa (FI); Esa Virtanen, Vassa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/633,774

(22) Filed: Feb. 27, 2015

(65) Prior Publication Data

US 2015/0167704 A1 Jun. 18, 2015

Related U.S. Application Data

(63) Continuation of application No. PCT/EP2013/067546, filed on Aug. 23, 2013.

(30) Foreign Application Priority Data

Aug. 29, 2012 (EP) ..... 12182143

(51) Int. Cl.
*F15B 21/00* (2006.01)
*H01F 27/14* (2006.01)

(52) U.S. Cl.
CPC ..... *F15B 21/006* (2013.01); *H01F 27/14* (2013.01); *E02B 2201/00* (2013.01); *Y10T 137/3115* (2015.04)

(58) Field of Classification Search
CPC ..... F15B 21/006; H01F 27/10; H01F 27/14; H01F 27/105; Y10T 137/3115; E02B 2201/00

(Continued)

(56) References Cited

U.S. PATENT DOCUMENTS 637,250 A * 11/1899 Hall ..... E03B 9/20 137/206
1,331,089 A * 2/1920 Berry ..... H01F 27/14 174/15.1

(Continued)

FOREIGN PATENT DOCUMENTS

CN 201696376 U 1/2011
DE 100 39 322 A1 7/2001

(Continued)

OTHER PUBLICATIONS

International Search Report (PCT/ISA/210) mailed on Nov. 28, 2013, by the European Patent Office as the International Searching Authority for International Application No. PCT/EP2013/067546.

*Primary Examiner* — John K Fristoe, Jr.
*Assistant Examiner* — Josephine Trinidad-Borges
(74) *Attorney, Agent, or Firm* — Taft Stettinius & Hollister LLP

(57) ABSTRACT

A pressure compensator is disclosed for a subsea electric installation, which includes a rigid bottle and a flexible bag placed in the rigid bottle, the pressure compensator including a first opening at a first end of the pressure compensator allowing fluid communication of an insulating medium arranged to intermediate space between the rigid bottle and the flexible bag, a second opening at a second end of the pressure compensator allowing fluid communication of seawater arranged within the flexible bag; and a bypass channel providing fluid communication between two points in the intermediate space of the pressure compensator.

12 Claims, 1 Drawing Sheet

(58) Field of Classification Search
USPC ..... 137/206, 81.2, 599.11
See application file for complete search history.

(56) References Cited

U.S. PATENT DOCUMENTS

| | | | | |
|---|---|---|---|---|
| 3,421,663 | A * | 1/1969 | Paton | B61D 5/002 222/135 |
| 3,448,219 | A * | 6/1969 | Nakazawa | H01F 27/14 174/12 R |
| 5,795,135 | A | 8/1998 | Nyilas et al. | |
| 6,059,539 | A | 5/2000 | Nyilas et al. | |
| 2003/0140838 | A1* | 7/2003 | Horton, III | B63B 9/065 114/264 |
| 2004/0051615 | A1 | 3/2004 | Hafskjold et al. | |
| 2011/0226369 | A1* | 9/2011 | Uusipaikka | E21B 33/0385 138/30 |

FOREIGN PATENT DOCUMENTS

| | | | |
|---|---|---|---|
| EP | 0 877 895 | A1 | 11/1998 |
| EP | 0 986 692 | A1 | 3/2000 |
| WO | WO 2007/055588 | A1 | 5/2007 |

* cited by examiner

PRESSURE COMPENSATOR

RELATED APPLICATION(S)

This application claims priority as a continuation application under 35 U.S.C. §120 to PCT/EP2013/067546, which was filed as an International Application on Aug. 23, 2013, designating the U.S., and which claims priority to European Application No. 12182143.3 filed in Europe on Aug. 29, 2012. The content of each prior application is hereby incorporated by reference in its entirety.

FIELD

The present disclosure relates to a transformer for use in a subsea environment, for example, to a bottle pressure compensator used in a subsea electric installation.

BACKGROUND INFORMATION

Subsea electric installations, such as transformers or frequency converters, are assemblies used under water. These installations can be filled with insulation fluid. During operation of the installation, temperature of the insulation fluid varies, whereby pressure compensation of the medium can be necessary. This can involve use of a pressure compensator, which can be in fluid communication with the interior of the installation. The pressure compensator is provided for receiving excess fluid when the temperature and volume of the fluid increases, and return the fluid back to the installation when the temperature of the fluid is lowered.

One type of pressure compensators is a bottle compensator. The bottle compensator can have a rigid bottle, and a flexible bag residing within the rigid bottle. The flexible bag can be connected to seawater outside the housing. The intermediate state between the flexible bag and the rigid bottle can act as a reservoir for receiving the excess fluid, such as oil, from the installation.

Known solutions for bottle compensators can have a drawback in that they can be poorly suited for arctic conditions where the temperature goes below zero. In such environments, if the installation is raised to the surface of water for maintenance, the existing bottle compensators can be prone to freezing damages.

SUMMARY

A pressure compensator is disclosed for a subsea electric installation, comprising: a rigid bottle; a flexible bag inside the rigid bottle; a first opening at a first end of the rigid bottle configured to allow fluid communication of an insulating medium to be received in an intermediate space between the rigid bottle and the flexible bag; a second opening at a second end of the rigid bottle configured to allow fluid communication of seawater to be received within the flexible bag; and a bypass channel providing fluid communication between two points in the intermediate space of the pressure compensator.

A subsea electric installation is disclosed, comprising: a pressure compensator including a rigid bottle, a flexible bag inside the rigid bottle, a first opening at a first end of the rigid bottle configured to allow fluid communication of an insulating medium to be received in an intermediate space between the rigid bottle and the flexible bag, a second opening at a second end of the rigid bottle configured to allow fluid communication of seawater to be received within the flexible bag; and a bypass channel providing fluid communication between two points in the intermediate space of the pressure compensator; and wherein the pressure compensator is mounted to the subsea electric installation such that the first opening is arranged vertically at a same level or higher than the second opening.

BRIEF DESCRIPTION OF THE DRAWINGS

The disclosure is explained below with reference to the exemplary embodiments shown in the drawings. In the drawings.

DETAILED DESCRIPTION

In accordance with an exemplary embodiment, a pressure compensator is disclosed, which can help avoid or at least alleviate some of the known issues of pressure compensators due to freezing.

Figure 1:
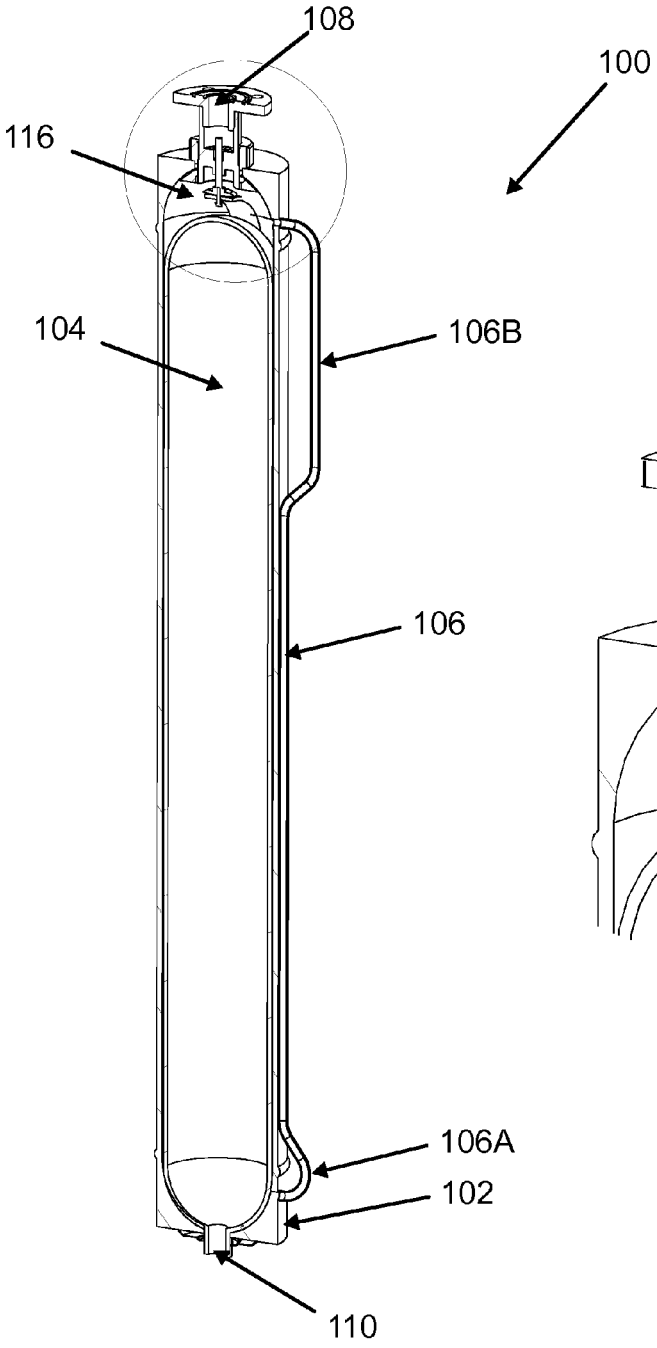
FIG. 1 shows an exemplary embodiment of a bottle compensator in a mounting position according to an exemplary embodiment of the disclosure.

FIG. 1 shows a vertically cut cross-section of an exemplary embodiment of a bottle-type pressure compensator 100. The compensator can have an elongate bottle-like structure, which can have a round, or at least substantially round cross-section when cut in horizontal direction.

The compensator 100 can have a rigid outer shell 102, which can be made of metal, for example. Inside the rigid outer shell can be placed a flexible bag or bladder 104. The flexible bag can be made of elastic material, such as rubber.

The compensator can have two openings 108, 110, one at substantially each end of the rigid bottle 102. The first opening 108 can connect the pressure compensator 100 for fluid communication to the subsea installation, such as a transformer or a frequency converter. The subsea installation can include rigid piping, to which the pressure compensator 100 is connected. Fastening and sealing equipment can be provided to attach and connect the pressure compensator to the installation.

The second opening 110 can be provided for seawater communication. Through the second opening 110, the water can enter to and exit from the flexible bag 104. At the second opening 110, the bag can be arranged to the rigid bottle 102 in a water-tight manner, such that the water can only enter into the interior of the bag 104 and not into the intermediate space 116 between the bag 104 and the bottle 102. In an exemplary embodiment, the bag can include a protruding outlet, which can be dimensioned slightly smaller than the second opening 110. In accordance with an exemplary embodiment, a sleeve can be attached to the outlet portion of the bag 104, which can project slightly out from the opening 110 of the bottle. The sleeve can include threads, which can be attachable to counter-threads of a fastening element that can fasten the outlet of the bag 104 to the second opening 110 of the bottle.

FIG. 1 shows the bottle compensator in the principal mounting position, that can be, in a vertical position in which the seawater connector 110 points downwards. Even though the bottle has been shown in a vertical position, the bottle can be mounted in other positions. However, the exemplary embodiments relate to mounting positions, where the water connector 110 resides at the same or lower level than the insulating medium connector 108. The mounting position can thus vary between the shown vertical position and horizontal position of the compensator.

In accordance with an exemplary embodiment, an intermediate space 116 can be located between the flexible bag 104 and the rigid bottle 102. During use, the intermediate space 116 can contain insulating medium, such as transformer oil, that has entered the space 116 via the first opening 108. Initially, before lowering the installation to water, the compensator can be initialized such that half of the total volume is filled with oil, and half of the volume interior of the bag 104, is filled with air. When the transformer is lowered into the water, seawater at least partly replaces the air.

The bottle compensator can include a bypass channel, which can alleviate fluid communication between two points in the intermediate space 116. In an exemplary embodiment, the two points can be substantially at the ends of the bottle as shown in FIG. 1. FIG. 1 shows a bypass pipe 106 that connects the ends of the bottle via two bypass openings. Close to the bypass openings, the bypass pipe can have curved sections 106A, 106B to approach the bottle substantially perpendicularly such as to alleviate fluid flow therein.

As FIG. 1 shows, the bypass channel can be provided as a bypass pipe 106 arranged exterior to the bottle.

In an exemplary embodiment, the bypass channel can be arranged as a pipe that can be provided within the rigid bottle 102 in the intermediate space 116.

In an exemplary embodiment, the channel can be provided by arranging one or more grooves, to the interior wall of the bottle thus allowing the fluid, such as transformer fluid to flow in the intermediate space.

In an exemplary embodiment, the bypass channel can be formed by means of a separating member, which can keep the interior of the bottle and the flexible bag separated from each other such that a bypass channel can be formed within the bottle. In an exemplary embodiment, the separating member can be one or more protrusion(s)/bar(s) arranged on one of the bag or the bottle. The protrusion can be longitudinal. In an exemplary embodiment, the separating member can include a set of protrusions, which together form a channel for the intermediate fluid. The protrusions can take various forms, for example, the protrusions can be point-like.

In the exemplary embodiments disclosed, a bypass channel can be provided for allowing the flow of insulating medium between two points in the intermediate space. In an exemplary embodiment, the channel can be arranged in the form of a pipe. In an exemplary embodiment, the channel can be formed by keeping the bottle and the flexible bag at least partly separated from each other, for example, by means of a projection and/or a groove in one or both of the bottle and the bag.

Although in the above, reference has been made to only one bypass channel, the pressure compensator can include multiple such channels. In addition, although reference has been mainly made to that the bypass channel can connect the two ends of the pressure compensator, the bypass channel can alternatively, or in addition to, connect two points that are closer to each other than at the ends of the bottle. Also in such a case, the bypass channel alleviates fluid communication between two points that are separated from each other in the longitudinal direction of the bottle.

In an exemplary embodiment, the bypass channel can be substantially parallel to the longitudinal direction of the bottle. For example, as shown in FIG. 1, even though there can be small sections of the channel 106A, 106B that are not parallel to the longitudinal direction of the bottle, the substantial direction of the channel is parallel to the longitudinal direction of the bottle. In an exemplary embodiment, the bypass channel(s) can be inclined to the longitudinal direction of the bottle.

Figure 2:
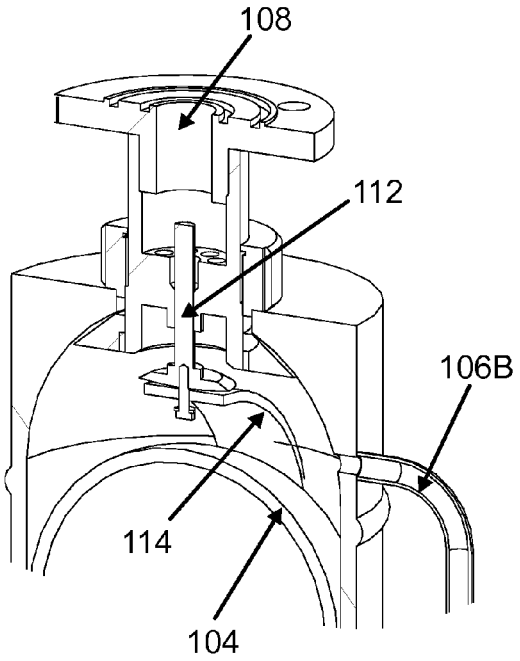
FIG. 2 shows a view of the area circle in FIG. 1 according to an exemplary embodiment of the disclosure.

FIG. 2 shows a view of the first end 108 of the pressure compensator 100, which can include a bypass channel in the form of a pipe 106B arranged exterior of the bottle, which pipe can enter the intermediate space 116 substantially perpendicularly.

In accordance with an exemplary embodiment, when the bypass channel is a pipe or a groove in the rigid bottle, the channel can extend closer to the end of bottle than the end of the flexible bag. For example, in this way, it can be relatively ensured that the bag in no circumstances is able to block the fluid communication in the channel. This can apply to one or both of the first and second ends of the bottle.

In accordance with an exemplary embodiment, a separating member 112 can keep the bag separated from the first opening 108. The separating member 112 can thereby prevent the bag from blocking the fluid flow and slipping into the opening 108.

The separating member 112 can include a planar surface arranged at a distance from the opening 110 such the insulating medium can flow between the planar surface and the inner wall of the bottle.

In accordance with an exemplary embodiment, a support member 114 can be provided for supporting the bag in the bottle. In an exemplary embodiment, the support member can include a fastening member, which can fix or fasten one portion of the bag with respect to the bottle. In an exemplary embodiment, the fastening member can fasten the bag to the bottle. In an exemplary embodiment, shown in FIG. 2, the fastening member can fasten the bag to the separating member 112.

In an exemplary embodiment, the fastening member can include a strap, which can be attached to the bag and one of the bottle or the separating member. The strap can be flexible.

In an exemplary embodiment, the support member can include one or more rods, which can be arranged to maintain substantially the length of the bag. In an embodiment, the rod can be arranged inside the bag. In another embodiment, the rod can be arranged to a receptacle provided on the outer surface of the bag. The rod can be substantially rigid and the length of the rod can be at least half of the length of the bag. The rod can be made of, for example, metal or plastic. In accordance with an exemplary embodiment, the rod has no sharp portions, such that puncturing of the bag can be prevented.

The pressure compensator according to previous exemplary embodiments can be suitable for use in a position, where the water connector 110 can be at the same or a lower level than the connector 108 for the insulating medium.

Thus, it will be appreciated by those skilled in the art that the present invention can be embodied in other specific forms without departing from the spirit or essential characteristics thereof. The presently disclosed exemplary embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A pressure compensator for a subsea electric installation, comprising:

a rigid bottle;

a flexible bag inside the rigid bottle;

a first opening at a first end of the rigid bottle configured to allow fluid communication of an insulating medium to be received in an intermediate space between the rigid bottle and the flexible bag;

a second opening at a second end of the rigid bottle configured to allow fluid communication of seawater to be received within the flexible bag;

a support member for supporting the flexible bag such that a length of the flexible bag is maintained, the support member comprising a fastening member for fastening an end of the flexible bag to the first end of the rigid bottle;

a separation member for separating the flexible bag from the first opening to ensure fluid communication in the first opening; and a bypass channel providing fluid communication between two points in the intermediate space of the pressure compensator;

wherein the bypass channel connects the first end of the pressure compensator to the second end of the pressure compensator; and wherein the fastening member is attached to the separation member.

2. The pressure compensator according to claim 1, wherein the rigid bottle has an elongated form and the bypass channel is arranged parallel to a longitudinal direction of the rigid bottle.

3. The pressure compensator according to claim 1, wherein the separation member keeps the flexible bag and the rigid bottle at least partly at a distance from each other such that the bypass channel is formed in the intermediate space.

4. The pressure compensator according to claim 3, wherein the separation member comprises:

a groove or a protrusion on the inner surface of the rigid bottle and/or a groove or a protrusion on the outer surface of the flexible bag such as to separate the rigid bottle and the flexible bag at least partly from each other such that the bypass channel is formed between the inner surface of the rigid bottle and the outer surface of the flexible bag.

5. The pressure compensator according to claim 1, wherein the bypass channel comprises:

a bypass pipe.

6. The pressure compensator according to claim 1, wherein the bypass pipe is exterior to the rigid bottle.

7. The pressure compensator according to claim 1, wherein the pressure compensator is mounted in a substantially vertical position, and wherein the first opening is higher than the second opening.

8. The pressure compensator according to claim 1, wherein the support member comprises:

a rod arranged in contact with the flexible bag, such that a length of the flexible bag is maintained.

9. A subsea electric installation, comprising:

a pressure compensator including a rigid bottle, a flexible bag inside the rigid bottle, a first opening at a first end of the rigid bottle configured to allow fluid communication of an insulating medium to be received in an intermediate space between the rigid bottle and the flexible bag, a second opening at a second end of the rigid bottle configured to allow fluid communication of seawater to be received within the flexible bag, a support member for supporting the flexible bag such that a length of the flexible bag is maintained, the support member comprising a fastening member for fastening an end of the flexible bag to the first end of the rigid bottle, a separation member for separating the flexible bag from the first opening to ensure fluid communication in the first opening; and a bypass channel providing fluid communication between two points in the intermediate space of the pressure compensator; wherein the bypass channel connects the first end of the pressure compensator to the second end of the pressure compensator; and wherein the fastening member is attached to the separation member; and wherein the pressure compensator is mounted to the subsea electric installation such that the first opening is arranged vertically at a same level or higher than the second opening.

10. The subsea electric installation according to claim 9, wherein the subsea electric installation is a transformer.

11. The subsea electric installation according to claim 9, wherein the rigid bottle has an elongated form and the bypass channel is arranged parallel to a longitudinal direction of the rigid bottle.

12. The subsea electric installation according to claim 9, wherein the separation member keeps the flexible bag and the rigid bottle at least partly at a distance from each other such that the bypass channel is formed in the intermediate space; and comprising:

a groove or a protrusion on the inner surface of the rigid bottle and/or a groove or a protrusion on the outer surface of the flexible bag such as to separate the rigid bottle and the flexible bag at least partly from each other such that the bypass channel is formed between the inner surface of the rigid bottle and the outer surface of the flexible bag.

* * * * *